US005444428A

United States Patent [19]

Carr et al.

[11] Patent Number: 5,444,428

[45] Date of Patent: Aug. 22, 1995

[54] FUSEHOLDER

[75] Inventors: Francis L. Carr, Downers Grove; George P. Canell, Schaumburg, both of Ill.

[73] Assignee: SAFCO Corporation, Chicago, Ill.

[21] Appl. No.: 246,282

[22] Filed: May 19, 1994

[51] Int. Cl.[6] ..... H01H 85/02; H01R 13/68; H01R 33/95

[52] U.S. Cl. ..... 337/188; 337/198; 337/201; 439/622

[58] Field of Search ..... 337/186, 187, 196, 198, 337/201, 205, 188, 191; 439/622, 830, 621

[56] References Cited

U.S. PATENT DOCUMENTS

| | | | |
|---|---|---|---|
| 4,391,485 | 7/1983 | Urani . | |
| 4,648,674 | 3/1987 | Sanchez . | |
| 4,836,803 | 6/1989 | Seidel | 439/447 |
| 4,941,851 | 7/1990 | Hsueh | 439/621 |
| 4,997,394 | 3/1991 | Katz | 439/622 |
| 5,034,846 | 7/1991 | Hodge | 361/119 |
| 5,055,071 | 10/1991 | Carlson | 439/621 |
| 5,252,081 | 10/1993 | Hart | 439/98 |

*Primary Examiner*—Leo P. Picard

*Assistant Examiner*—Stephen T. Ryan

*Attorney, Agent, or Firm*—Augustus G. Douvas

[57] ABSTRACT

An integral plastic fuseholder for receiving portions of a pair of in-line electrical conductors which may be connected to a non-fused electrical adapter plug. One conductor of the pair is severed within the holder to form an open connection until the connection is completed by a flat-blade insertion fuse. A pair of female electrical terminals is located within the fuseholder with each terminal connected to a different end of the severed conductor. The fuseholder has a foldable clamshell housing formed by a pair of foldable cover sections which are joined by a centrally disposed hinge section. The housing is opened to receive the in-line electrical conductor pair, or alternatively is folded to a closed position to retain the in-line conductor pair and to create a partially enclosed cavity which forms a fuse-insert access opening opposite the hinge section. Any inserted fuse is connected in series with the conductor terminals to complete a fused conductor connection to an adapter plug through the fuseholder. A removable cap is provided to close the fuse-insert access opening.

3 Claims, 4 Drawing Sheets

FUSEHOLDER

This invention relates to a fuseholder adapted for snap-on connection to one or more electrical conductors so that an otherwise unfused load may be adequately protected by a fuse.

BACKGROUND OF THE INVENTION

The use of male adapter plugs, which are inserted into receptacles powered by a vehicle battery or other power system, is being extended to new applications requiring increased current loads. Adapter plugs are available in the prior art both with built-in integral fuses and also without fuses. In many adapter-plug designs having integral fuses, only fuses in the range of three amperes or less may be used; however, load currents can extend to fifteen amperes or more for some appliances powered by adapter-plug line cords.

The prior art includes an automobile in-line fuseholder which receives and encloses a standard automobile flat-blade insert fuse. This fuseholder can be used with an electrical conductor connected to an adapter plug. However, since the fuseholder is molded on and over the line cord, the adapter plug must be disassembled in order to establish a fused connection with the fuseholder.

SUMMARY OF THE INVENTION

Accordingly, a principal object of their invention is to provide a fuseholder which can be easily applied to an unfused conductor or a pair of unfused conductors.

Another object of their invention is to provide a fuseholder for an unfused load which can be applied to a line cord attached to an adapter plug, a receptacle or other electrical device without requiring disassembly of the plug, receptacle device or load.

Another object is to provide an in-line fuseholder which can be snapped onto a line cord without disturbing any input or output accessory connected to the ends of the line cord.

A preferred embodiment of the fuseholder of this invention comprises an integral single-piece housing for receiving portions of a pair of in-line electrical conductors which may be connected to a non-fused electrical adapter plug. One conductor of the pair is severed within the holder to form an open connection until the connection is completed by a flat-blade insertion fuse. A pair of female electrical terminals is located within the fuseholder with each terminal connected to a different end of the severed conductor. The fuseholder has a foldable "clam-shell" housing formed by a pair of foldable cover sections joined by a centrally disposed hinge section. The housing is opened to receive the in-line electrical conductor pair, or alternatively is folded to a closed position to create a partially closed cavity which forms a fuse-insert access opening opposite the hinge section. Any inserted flat-blade fuse is connected in series with the conductor terminals to complete a fused conductor connection through the fuseholder to the adapter plug.

DESCRIPTION OF THE DRAWINGS

In order that all of the structural features for attaining the objects of this invention may be understood, reference is made to the accompanying drawings in which.

DETAILED DESCRIPTION OF THE PREFERRED EMBODIMENT

Figure 1:
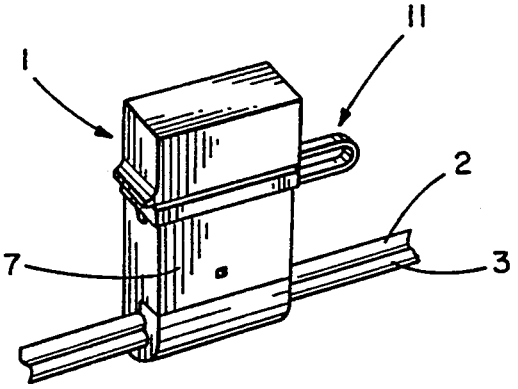
FIG. 1 is an isometric view of a capped fuseholder of this invention engaging a pair of twin conductors.
Figure 2:
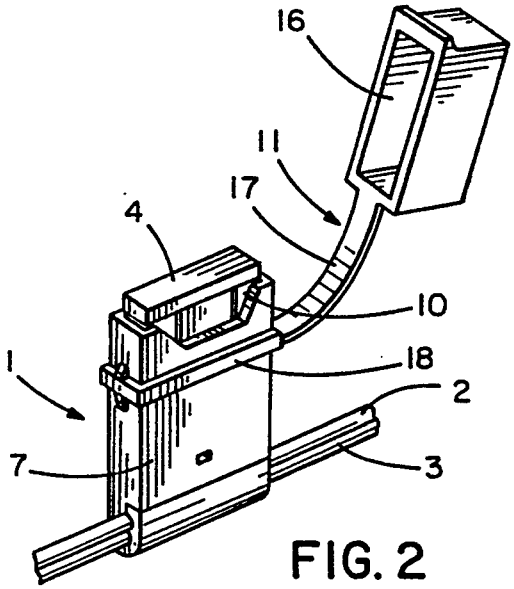
FIG. 2 is a view related to FIG. 1 which shows the fuseholder cap disengaged from the fuseholder housing to provide access to a flat twin-blade fuse.
Figure 3:
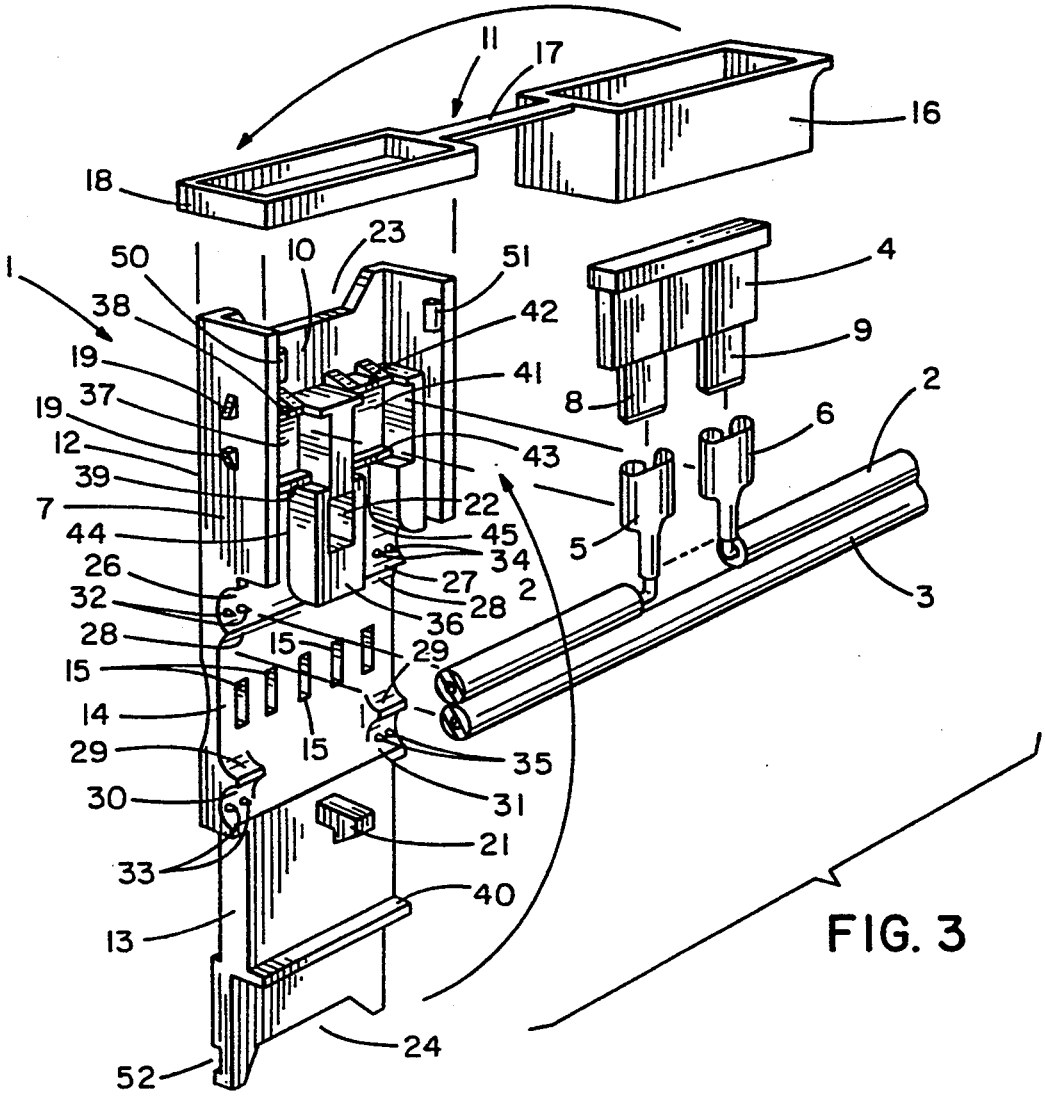
FIG. 3 is an exploded view which shows the fuseholder housing in an unfolded position, the fuseholder cap assembly disengaged from the fuseholder housing, and a pair of twin conductors in which one conductor is prepared with a set of female electrical terminals for receiving a flat blade fuse.
Figure 14:
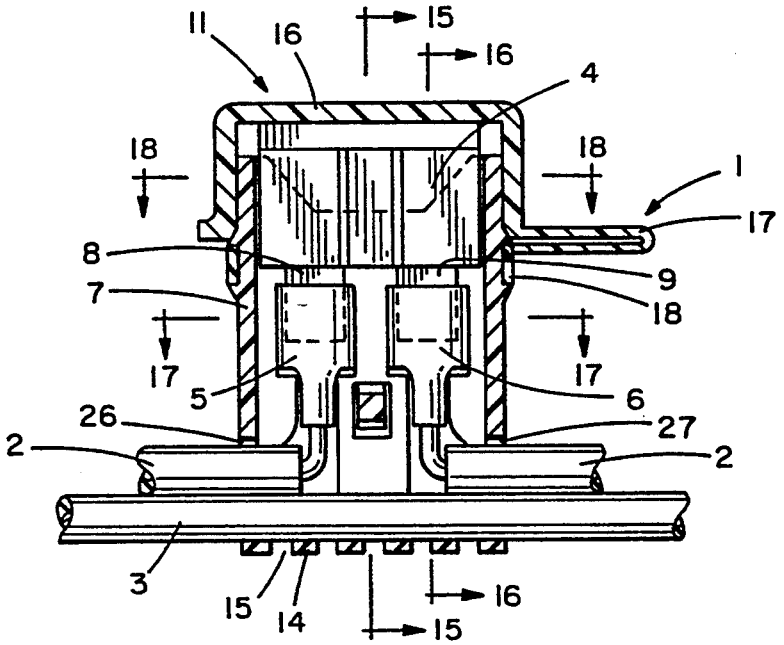
FIG. 14 is a section view taken along line 14—14 of FIG. 13 which shows the internal connection of a flat fuse to a pair female terminals fixed to a single line conductor of a pair of twin conductors engaged by the fuseholder housing.
Figure 15:
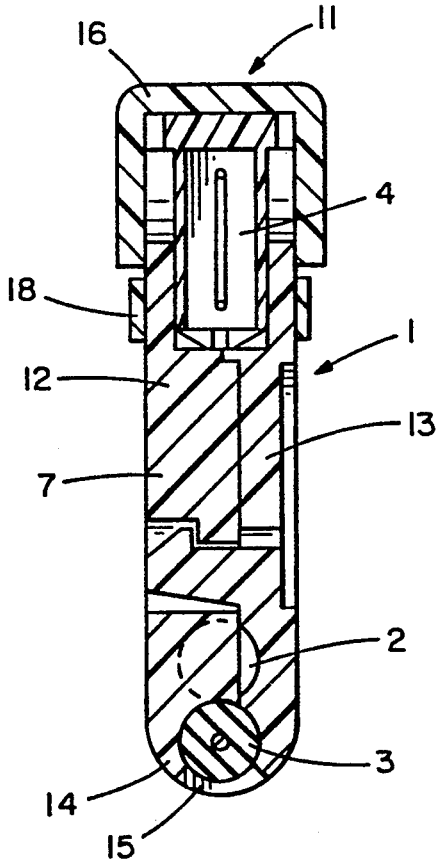
FIG. 15 is a section view taken along line 15—15 of FIG. 14.
Figure 16:
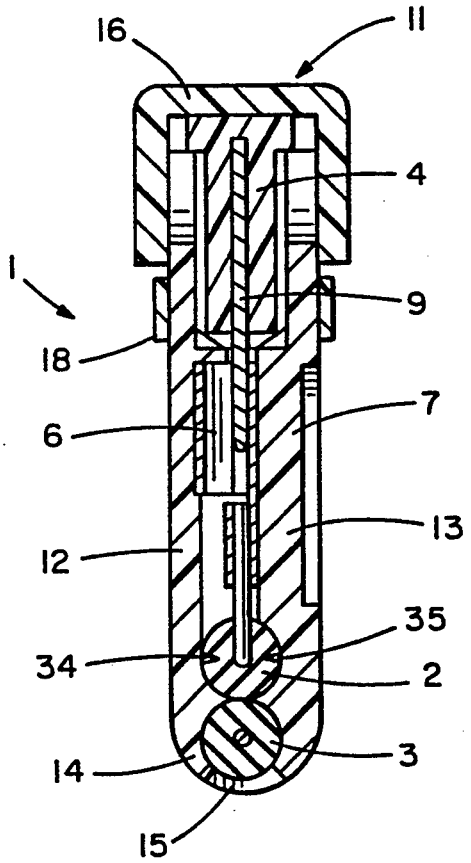
FIG. 16 is a section view taken along line 16—16 of FIG. 14.
Figure 17:
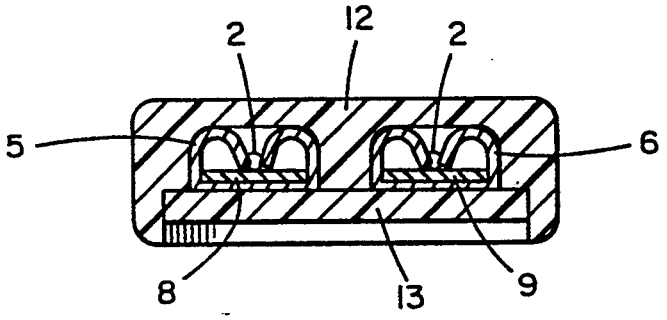
FIG. 17 is a section view taken along line 17—17 of FIG. 14.
Figure 18:
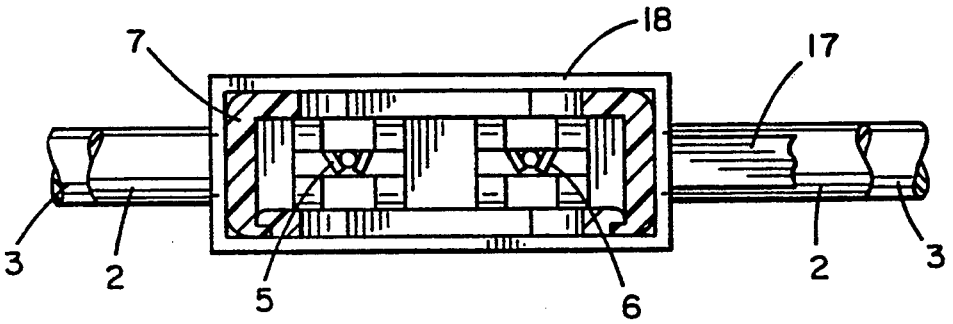
FIG. 18 is a modified section view taken along line 18–18 of FIG. 14 in which the fuse is removed.

Fuseholder 1 of this invention engages a pair of twin conductors 2 and 3 in such a manner that flat-blade insert fuse 4 completes a series electrical connection with conductor 2 (FIGS. 1, 2 and 3). Conductor 2 is severed (FIG. 3), and the conductor insulation is removed for a short length sufficient to receive female electrical terminals 5 and 6. Terminals 5 and 6 are housed within fuseholder housing 7 (FIG. 14). These terminals are located within the fuseholder housing to receive fuse blades 8 and 9 when the fuse is inserted in end access opening 10 formed by folding fuseholder housing 7 (FIGS. 1, 2, 12, 15 and 16).

Figure 10:
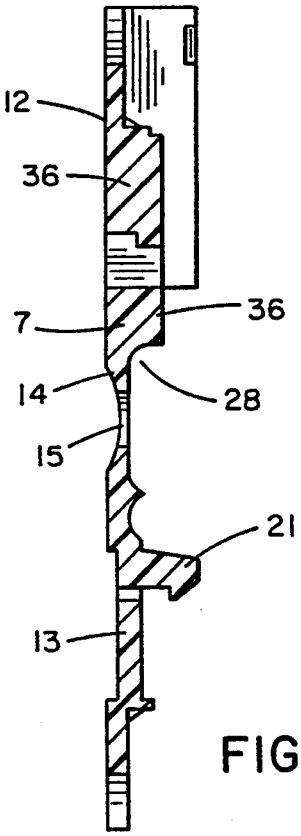
FIG. 10 is a section view taken along line 10—10 of FIG. 4.
Figure 11:
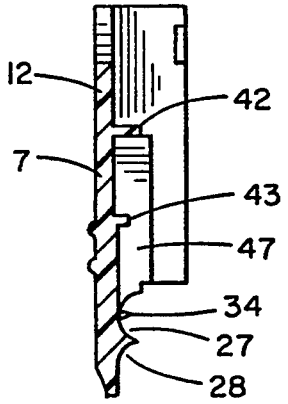
FIG. 11 is a section view taken along line 11—11 of FIG. 4.
Figure 12:
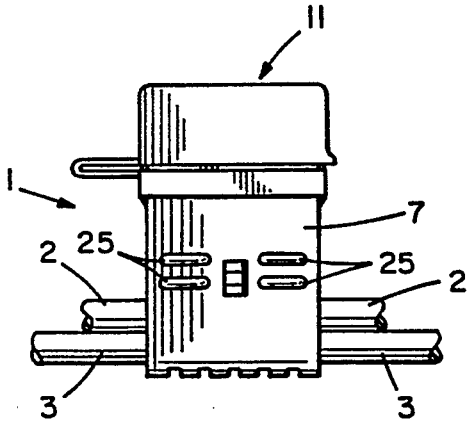
FIG. 12 is a view related to FIG. 1 which shows the side of the fuseholder housing opposite to that shown in FIG. 1.
Figure 13:
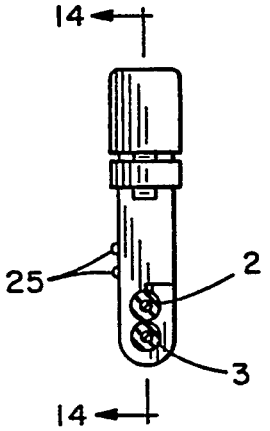
FIG. 13 is a side elevation view of the fuseholder housing of FIG. 12.

Fuseholder 1 comprises two separable parts, namely fuseholder housing 7 and end cap assembly 11 (FIGS. 1, 2, 3, 12, 13 and 14). Both parts are fabricated from a flexible plastic, such as polypropylene, because each part has an integral hinge section that is required to fold. In particular, housing 7 comprises a fuse and conductor retaining cover section 12 and a locking cover section 13 integrally joined by a hinge section 14. Hinge section 14 is formed with a series of five rectangular hinge holes 15 which facilitate folding (FIG. 3). As is best shown in FIG. 10, hinge section 14 is also reduced in wall thickness in the areas adjacent hinge holes 15 to further promote ease of folding. End cap assembly 11 includes a cap 16 integrally joined to flexible plastic cap hinge 17 which in turn is integrally attached to rectangular ring 18 (FIGS. 1 and 3). Ring 18 is attached to housing 7 by folding housing 7 as is shown in FIGS. 1 and 2 and slipping the ring over the end of the housing until the short bands of ring 18 are captured by the pair of catch sets 19 and 20 (FIGS. 2, 3, 4, 5, and 6).

When housing 7 is folded, projecting lock finger 21, which is supported on an inside surface of cover section 13 (FIGS. 2, 3, 4 and 5), mates with lock hole 22 to lock cover sections 12 and 13 in the folded position. Thereafter, the placement of ring 18 in catch sets 19 and 20 further assures retention of housing 7 in the folded position.

Figure 4:
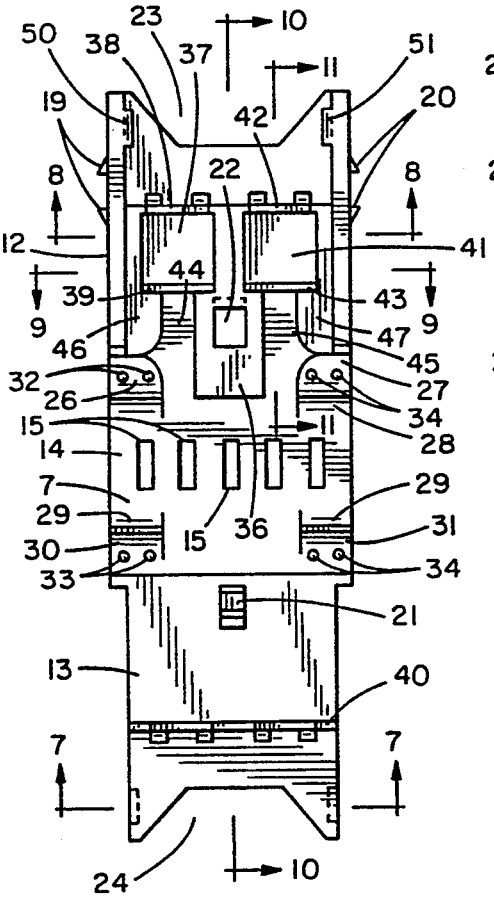
FIG. 4 a plan view which shows the internal construction of an unfolded fuseholder housing.
Figure 5:
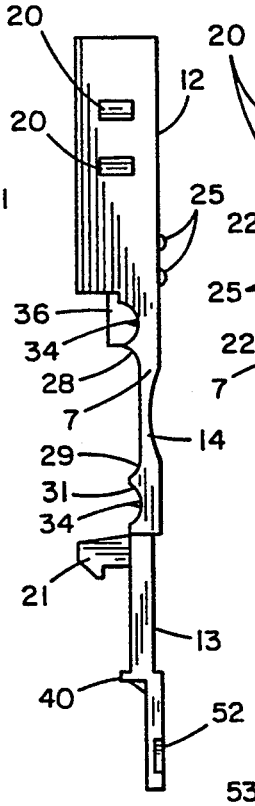
FIG. 5 is a side elevation view of the fuseholder housing of FIG. 4.
Figure 6:
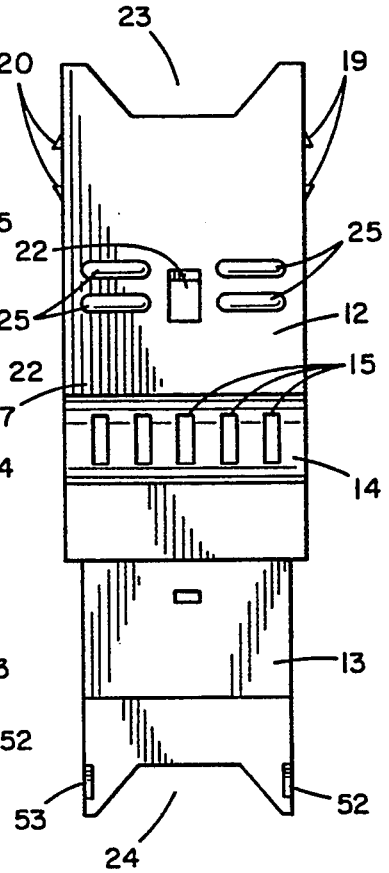
FIG. 6 a plan view which shows the external construction of the folded fuseholder housing.
Figure 7:
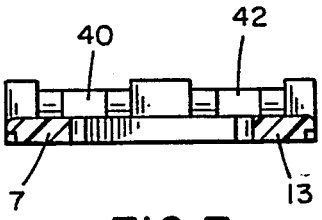
FIG. 7 is a section view taken along line 7—7 of FIG. 4.

The ends of cover sections 12 and 13 are formed with notches 23 and 24, respectively (FIGS. 3, 4 and 6). These notches expose a portion of flat fuse 4 so that the fuse can be easily inserted and removed manually frown fuseholder 1. Additionally, a set of four projecting finger grips 25 are formed on an outer surface of cover sections 12 to facilitate manual handling of fuseholder 1.

A set of partially cylindrical conductor passage sections 26, 27, 28, 29, 30 and 31 (FIGS. 3, 10 and 14) are formed on the inside of cover sections 12 and 13. The severed left end of conductor 2 (as viewed in FIGS. 3 and 14) is received by passage sections 26 and 30; and the severed right end of conductor 2 is received by passage sections 27 and 31. Through conductor 3 is received by through passage sections 28 and 29. Four sets of strain-relief barbs 32, 33, 34 and 35 (FIG. 3) project from the inside walls of passage sections 26, 30, 27 and 31, respectively. These barbs engage the insulation cover of severed conductor 2 to assist in locking the separated internal ends of this conductor in place relative to fuseholder 1 and to relieve any possible external pulling force that might otherwise be applied to terminals 5 and 6. No strain-relief barbs are located within through passage sections 28 and 29.

A terminal separating block 36 is supported on the inside surface of cover section 12 (FIGS. 3 and 4). When housing 7 is folded, the projection of block 36 separates closed passage sections 26–30 from closed passage sections 27–31 to assist in separating terminals 5 and 6 from one another to prevent an electrical short. The projection of block 36 is restricted, however, from obstructing closed through passage sections 28–29. The mating passage sections formed by folding housing 7 establishes one through passage for conductor 3, and an obstructed passage for conductor 2 which leads into divided terminal access passage 44–45.

A compartment 37 for receiving terminal 5 is formed by walls 38 and 39 and rib 40 when housing 7 is folded (FIGS. 3, 4 and 14); and compartment 41 for receiving terminal 6 is similarly formed by walls 42 and 43 and rib 40. The wire-containing stems of terminals 5 and 6 are received by divided terminal access passage 44–45. This passage leads to compartments 37 and 41. Terminal access passage 44–45 is divided by separating block 36 (FIG. 4). Access passage 44–45, as well as compartments 37 and 41, are further defined by end-wall reinforcing ribs 46 and 47 (FIG. 4). Reinforcing ribs 46 and 47 reinforce ends walls 38, 39, 42 and 43 to prevent a pulling stress on terminals 5 and 6 exerted either by conductor 2 or fuse 4 from displacing the terminals from their respective compartments.

Figure 8:
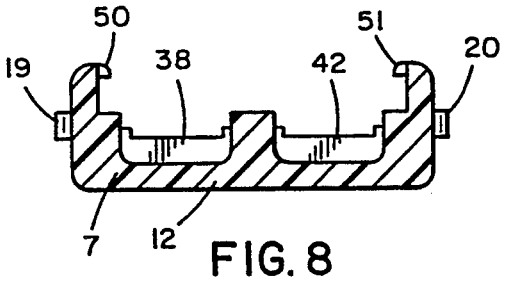
FIG. 8 is a section view taken along line 8—8 of FIG. 4.
Figure 9:
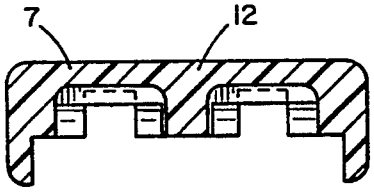
FIG. 9 is a section view taken along line 9—9 of FIG. 4.

Sidewalls 48 and 49 of cover section 12 (FIGS. 3 and 8) support a pair of locking tabs 50 and 51. When housing 7 is folded, tabs 50 and 51 engage edge recesses 52 and 53 formed on the sides of cover section 13 to further assure locking.

It should be understood that the preferred embodiment of the invention can be modified without departing from the scope of the invention.

What is claimed is:

1. A fuseholder for receiving a flat insert fuse and a pair of closely-disposed parallel twin conductors both of which conductors enter and exit the fuseholder and in which the fuse completes a series electrical connection with one the electrical conductors which is severed to form a pair of severed conductor ends to which terminals are applied with the conductor ends being located within the fuseholder for connection to the fuse and the non-severed conductor being a through conductor, comprising a foldable clam-shell housing having a pair of foldable cover sections joined by a centrally disposed hinge section which defines a fold line, a pair of generally parallel and one-half cylindrical conductor passage sections fox meal within the interior of each of the cover sections adjacent to and parallel to the hinge-section fold line and forming twin generally cylindrical passage sections formed within the interior of each of receiving and retaining the pair of twin conductors when the clam-shell fuseholder housing is folded into a closed position, a pair of separated terminal compartments formed within the interior of one of the cover sections each of which compartment is to receive a different severed conductor end and to which an electrical terminal is applied for establishing a electrical connection to any fuse inserted within the fuseholder, a pair of divided terminal access passage sections formed within the interior of the cover section containing the terminal compartments with each access passage section extending from a different one of the terminal compartments to communicate with the generally cylindrical conductor passage section farthest removed from the hinge section fold line which to receive the severed conductor, and a fuse insert cavity formed within the interior of housing sections adjacent the terminal compartments for receiving an insert fuse which establishes a series electrical connection with the terminals of any severed conductor ends located within the terminal compartments to thereby fuse the severed conductor of any twin conductor pair entering and exiting the fuseholder.

2. The fuseholder of claim 1 comprising a terminal separating block located within the interior of the housing section containing the terminal access passage sections to separate each severed conductor end and its respective terminal from shorting any inserted fuse.

3. The fuseholder of claim 2 in which the terminal separating block obstructs the severed conductor passage.

* * * * *